US006916406B2

(12) United States Patent
Baird

(10) Patent No.: US 6,916,406 B2
(45) Date of Patent: Jul. 12, 2005

(54) COKE OVEN DOOR

(75) Inventor: Billy Carr Baird, Sturgis, KY (US)

(73) Assignee: Saturn Machine & Welding Co., Inc., Sturgis, KY (US)

( * ) Notice: Subject to any disclaimer, the term of this patent is extended or adjusted under 35 U.S.C. 154(b) by 148 days.

(21) Appl. No.: 10/375,601

(22) Filed: Feb. 27, 2003

(65) Prior Publication Data

US 2004/0168902 A1 Sep. 2, 2004

(51) Int. Cl.[7] ..... C10B 25/00; C10B 25/24

(52) U.S. Cl. ..... 202/242; 202/248; 202/267.1; 202/268; 202/269; 202/270

(58) Field of Search ..... 202/248

(56) References Cited

U.S. PATENT DOCUMENTS 3,629,094 A * 12/1971 Silverblatt ..... 202/248
4,186,055 A 1/1980 Baird et al.
4,189,352 A * 2/1980 Stanke ..... 202/248
4,263,101 A * 4/1981 Thiersch et al. ..... 202/248
4,400,240 A * 8/1983 Abendroth ..... 202/248
4,770,749 A * 9/1988 Schlosser ..... 202/242
5,238,539 A 8/1993 Baird
5,443,696 A 8/1995 Baird et al.
5,670,025 A 9/1997 Baird
5,720,855 A 2/1998 Baird

FOREIGN PATENT DOCUMENTS

GB 2156846 A 10/1985 ..... C10B/25/16

* cited by examiner

*Primary Examiner*—Glenn Caldarola
*Assistant Examiner*—Alexis Wachtel
(74) *Attorney, Agent, or Firm*—Wood, Herron & Evans, LLP

(57) ABSTRACT

A coke oven door comprises a generally rectangular outer frame, a generally rectangular inner frame positioned within the outer frame and a seal operably mounted to the inner frame and adapted for effecting sealing against a jamb of a coke oven. The outer frame is adapted for moving the seal toward the jamb and the outer and inner frames are pivotally connected so as to be able to pivot relative to one another about a longitudinal pivot axis.

27 Claims, 5 Drawing Sheets

COKE OVEN DOOR

FIELD OF THE INVENTION

This invention relates generally to coke oven doors, and more particularly to a coke oven door of an improved construction for effecting more efficient sealing engagement of the seal of the door with the sealing surface of a door jamb of a coke oven.

BACKGROUND OF THE INVENTION

Coke oven doors are of various constructions and include various types of seals for effecting sealing between the oven door and a jamb of a coke oven. Generally, a coke oven door has a relatively rigid door frame to which is peripherally mounted a seal in the form of a metal strip, a knife edge of which contacts the door jamb sealing surface for sealing therewith.

In use, the door jamb of a coke oven tends to become warped or distorted due to the extreme temperatures to which the jamb is subjected during the coking process. In addition, the coking process generates a hard carbon deposit, which deposit tends to coat the door jamb sealing surface creating irregularities around its periphery.

It is desirable to provide a coke oven door with a means by which to adjust the contour of the door as well as to adjust the door seal to provide for proper sealing of the door with the door jamb during use.

SUMMARY OF THE INVENTION

In one aspect a coke oven door comprises a generally rectangular outer frame, a generally rectangular inner frame positioned within the outer frame and a seal operably mounted to the inner frame and adapted for effecting sealing against a jamb of a coke oven, the outer frame adapted for moving the seal toward the jamb, the outer and inner frames pivotally connected so as to be able to pivot relative to one another about a longitudinal pivot axis.

The inner frame can include a pair of side frame members and a pair of end frame members. The outer frame can include a pair of side frame members and a pair of end frame members. The outer frame side frame members can be connected to the outer frame end frame members via pivot pin connections for relative pivotal movement such that the outer frame side frame members can remain parallel to the inner frame side frame members during pivoting of the outer frame relative to the inner frame about the longitudinal pivot axis.

The inner frame can include limit structure to maintain the outer frame side frame members generally parallel with the inner frame side frame members during pivoting of the outer frame relative to the inner frame about the longitudinal pivot axis.

The inner frame can include a base plate and a diaphragm plate. The seal can be operably mounted to the diaphragm plate around a periphery thereof. The diaphragm plate can be operably mounted to the base plate.

The outer frame can include selectably adjustable force applying members operably mounted thereto and adapted for moving the seal toward the jamb.

The diaphragm plate can be freely movable relative to the base plate within limits. The diaphragm plate can be movable in a direction perpendicular to a plane defined by the door jamb, in a direction parallel to the plane defined by the door jamb, or in the direction parallel to the plane defined by the door jamb and in the direction perpendicular to the plane defined by the door jamb.

The inner frame can include selectably adjustable force applying members operably mounted thereto and adapted for moving the outer frame toward the jamb.

In another aspect, a coke oven door comprises a generally rectangular outer frame, a generally rectangular inner frame positioned within the outer frame, a seat operably mounted to the inner frame and adapted for effecting sealing against a jamb of a coke oven, selectably adjustable force applying members operably mounted to the outer frame and adapted for moving the seal toward the jamb and selectably adjustable force applying members operably mounted to the inner frame and adapted for moving the outer frame toward the jamb.

In another aspect, a coke oven door comprises a generally rectangular frame including a pair of side frame members, a pair of end frame members and a base plate, a diaphragm plate and a seal operably mounted to the diaphragm plate around a periphery thereof and adapted for sealing against a jamb of a coke oven, the diaphragm plate operably mounted to the base plate so as to be freely movable relative thereto within limits in a direction parallel to a plane defined by the door jamb and in a direction perpendicular to the plane defined by the door jamb.

In another aspect, a coke oven door comprises a generally rectangular outer frame, a generally rectangular inner frame including a base plate and positioned within the outer frame, the outer and inner frames pivotally connected so as to be able to pivot relative to one another about a longitudinal pivot axis, a diaphragm plate, a seal operably mounted to the diaphragm plate around a periphery thereof and adapted for sealing against a jamb of a coke oven, the diaphragm plate operably mounted to the base plate so as to be freely movable relative thereto within limits in a direction parallel to a plane defined by the door jamb and in a direction perpendicular to the plane defined by the door jamb, selectably adjustable force applying members operably mounted to the outer frame and adapted for moving the seal toward the jamb and selectably adjustable force applying members operably mounted to the inner frame and adapted for moving the outer frame toward the jamb.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF THE INVENTION

Figure 1:
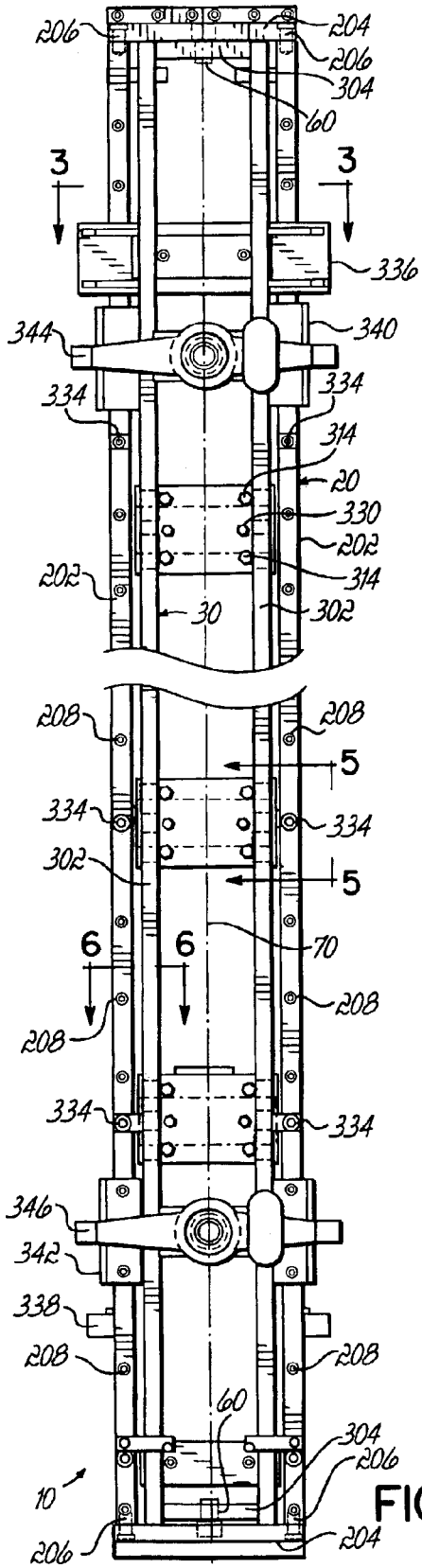
FIG. 1 is a front view of the coke oven door of the present invention.
Figure 2:
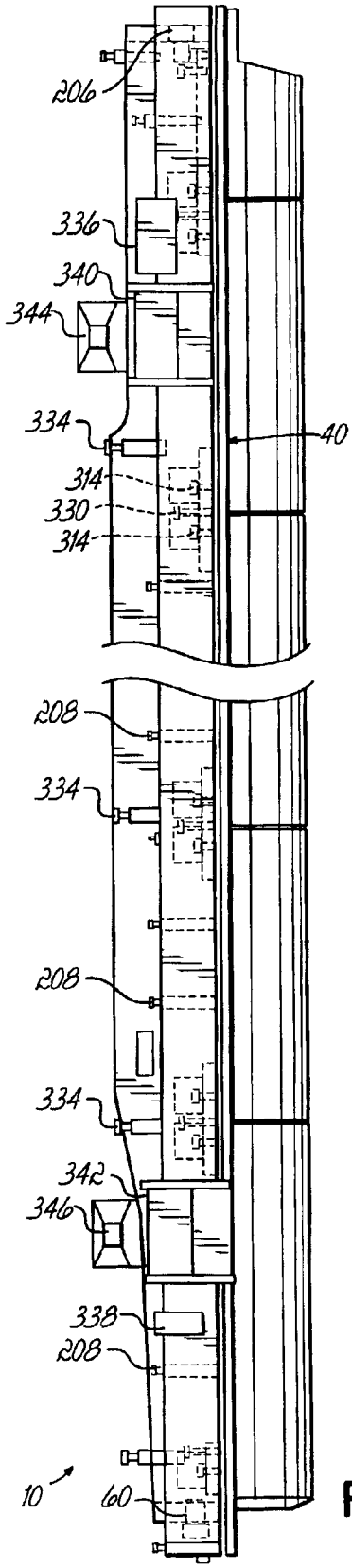
FIG. 2 is a side view thereof.
Figure 4B:
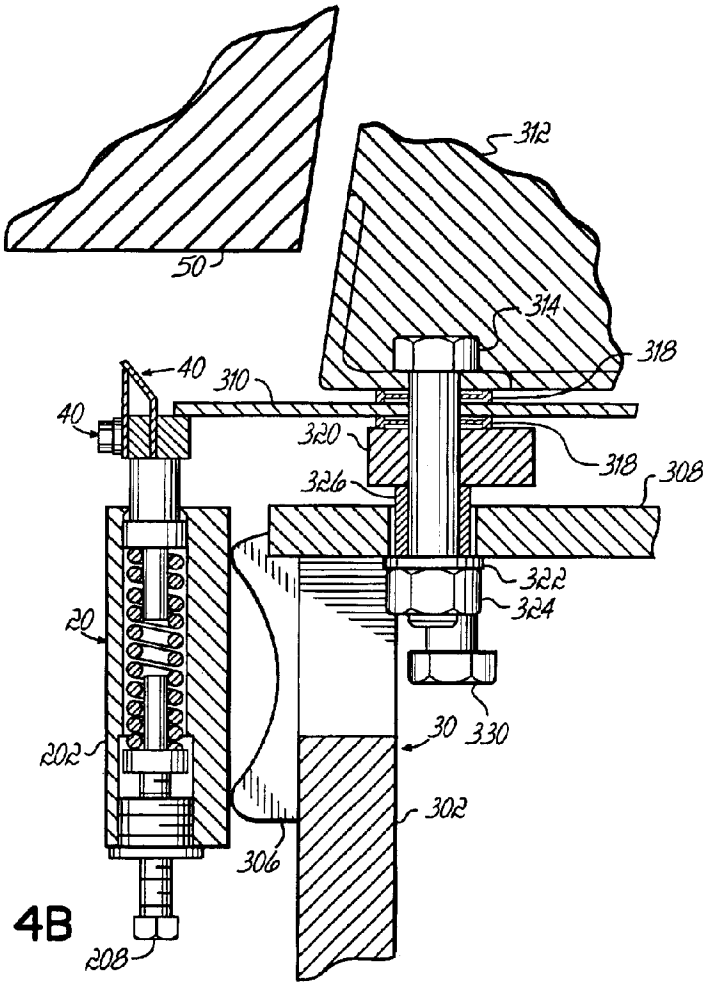
FIG. 4B is a view similar to FIG. 4 but illustrating the coke oven door seal out of engagement with the jamb of the coke oven.
Figure 4A:
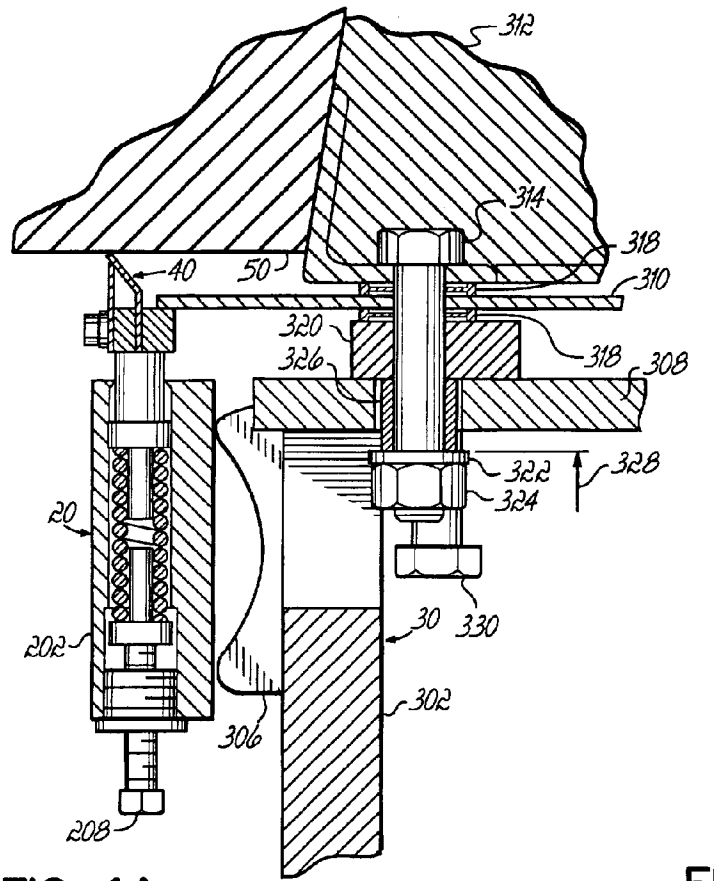
FIG. 4A is a view similar to FIG. 3, enlarged, illustrating the coke oven door seal in engagement with a jamb of a coke oven.

Referring first to FIGS. 1 and 2, there is illustrated a coke oven door 10. The door 10 comprises a general rectangular outer frame 20, a generally rectangular inner frame 30 and a seal 40 operably mounted to the inner frame 30 and adapted for effecting sealing against a jamb 50 of a coke oven (FIGS. 4A and 4B). As will be described in more detail below, the outer frame 20 is adapted for moving the seal 40 toward the jamb 50 of the coke oven 10. The outer 20 and inner 30 frames are pivotally connected as by pivot bearings 60 so as to be able to pivot relative to one another about a longitudinal pivot axis 70 of the coke oven door 10 (FIGS. 7A–7C).

The outer frame 20 can include a pair of side frame members 202 and a pair of end frame members 204. The inner frame 30 can likewise include a pair of side frame members 302 and a pair of end frame members 304. The outer frame side frame members 202 can be connected to the outer frame end frame members 204 via pins 206 for relative pivotal movement such that the outer frame side frame members 202 can remain parallel to the inner frame side frame members 302 during pivoting of the outer frame 20 relative to the inner frame 30 about the longitudinal pivot axis 70 (FIGS. 7A–7C).

Figure 3:
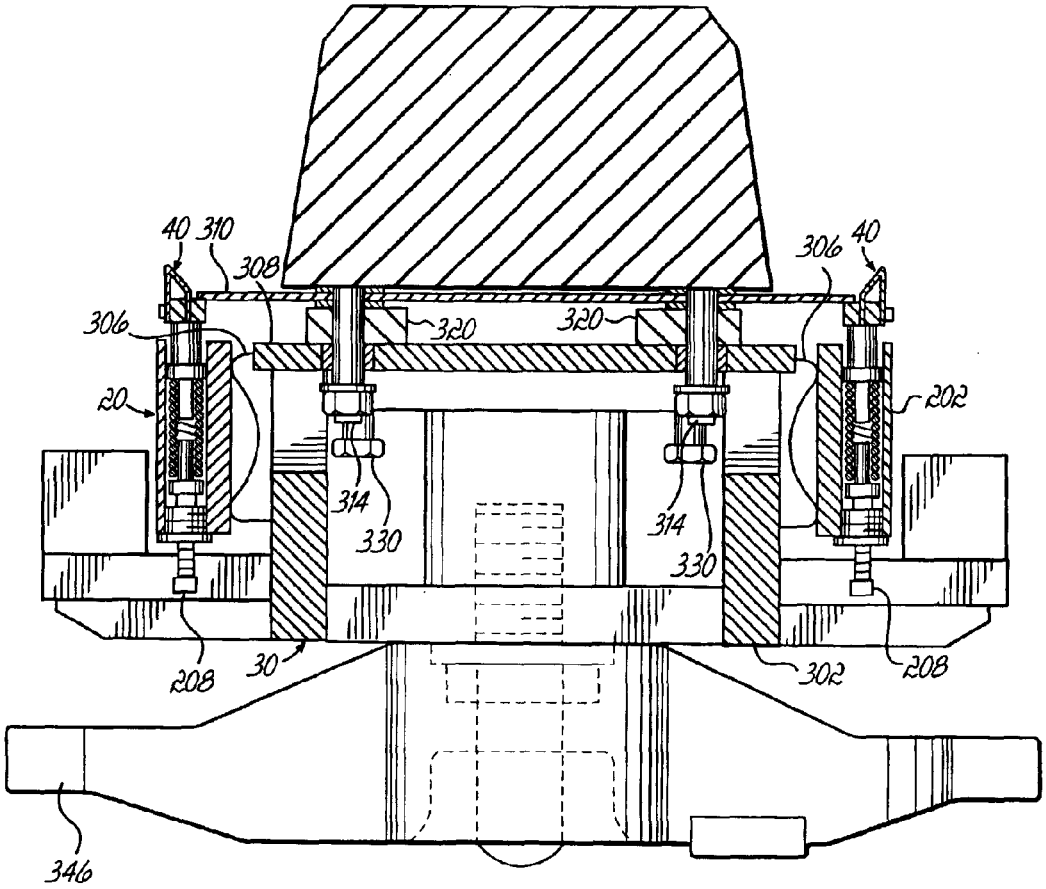
FIG. 3 is a view taken along line 3—3 of FIG. 1.
Figure 7A:
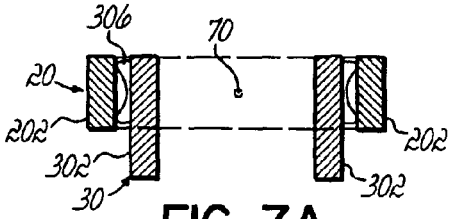
FIGS. 7A–7C are schematic end views of the coke oven door of the present invention illustrating the ability of the outer frame and inner frame to pivot relative to one another about a longitudinal pivot axis of the door.
Figure 7B:
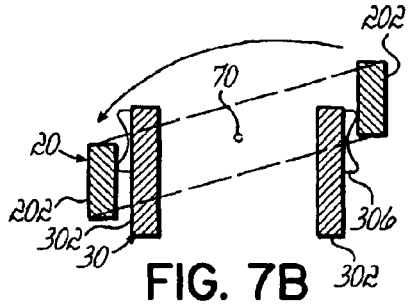
Figure 7C:
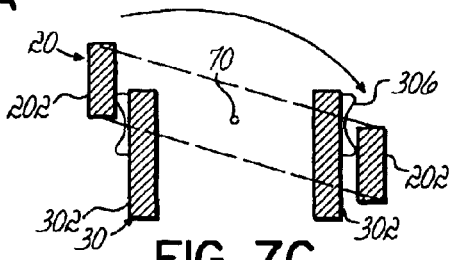

Referring to FIG. 3, the side frame members 302 of the inner frame 30 can include limit structure 306 to maintain the outer frame side frame members 202 generally parallel with the inner frame side frame members 302 during pivoting of the outer frame 20 relative to the inner frame 30 about the longitudinal pivot axis 70 (FIGS. 7A–7C).

Referring to FIGS. 3–6, the inner frame 30 can further include a base plate 308. The inner frame 30 can further include a diaphragm plate 310. Seal 40 can be operably mounted to the diaphragm plate 310 around the periphery thereof. Seal 40, as disclosed, is generally of the type shown in U.S. Pat. No. Re. 34,184, entitled Retrofit Coke Oven Door Seal, assigned to the assignee of the present invention and hereby incorporated by reference herein, though of course other seals could be used with the door 10. The diaphragm plate 310 can be operably mounted to the base plate 308, in a manner described below. The outer frame 20 can include selectably adjustable force applying members 208, for example spring plunger assemblies, operably mounted thereto and adapted for moving the seal 40 toward the coke oven jamb 50.

Referring still to FIGS. 3–6, the diaphragm plate 310 can be freely movable relative to the base plate 308 within limits. Referring to FIGS. 4A, 4B and 5A–5C, refractory plug 312 can have a plug bolt 314 which passes through a slot 316 in base plate 308. Slot 316 can be preferably be vertically oriented, that is, oriented in a direction parallel to a longitudinal axis of coke oven door 10. Smoke rings 318 can be positioned on either side of the diaphragm plate 310. A hanger bar 320 can be interposed between base plate 308 and smoke rings 318. A washer 322 and nut 324 can secure these elements together. A plug bolt spacer 326 can be interposed between hanger bar 320 and washer 322 and nut 324 providing free movement of the diaphragm plate 310 in a direction perpendicular to a plane defined by the door jamb 50 in an amount shown at 328. Diaphragm adjustment bolts 330 can be threaded into base plate 308 and to adjust or limit the amount of travel of the diaphragm plate 310 in the direction perpendicular to the plane defined by the door jamb 50 (FIGS. 5A–5C).

Figure 5B:
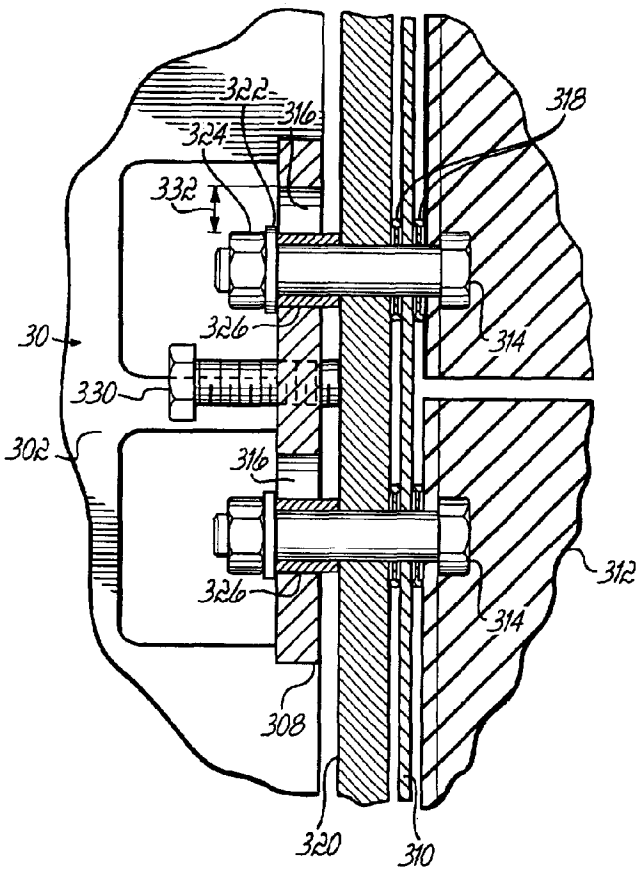
FIGS. 5A–5C are views taken along line 5—5 of FIG. 1 illustrating the travel of the diaphragm plate relative to the base plate in a direction perpendicular to the plane of the door jamb as limited (or not) by the diaphragm adjustment bolts.
Figure 5A:
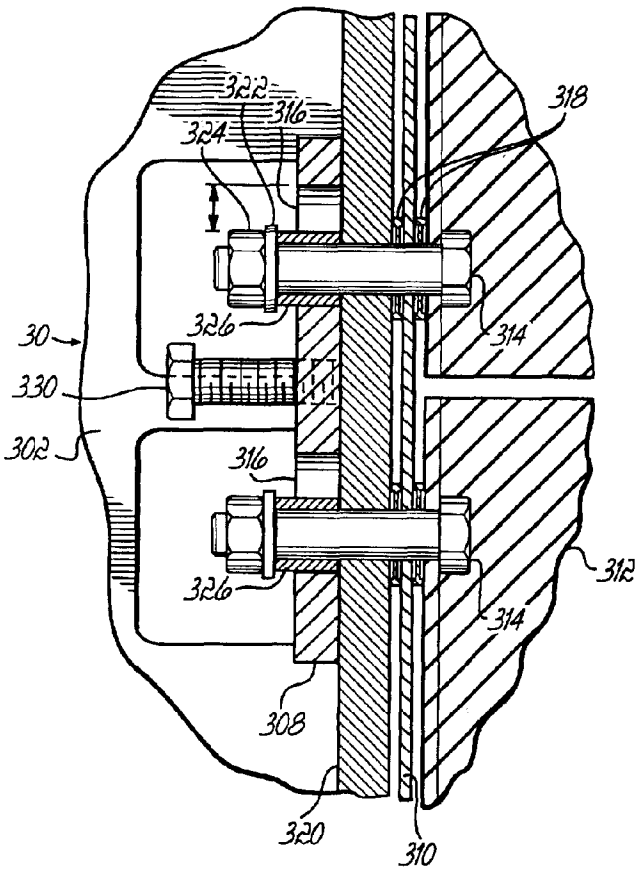
Figure 5C:
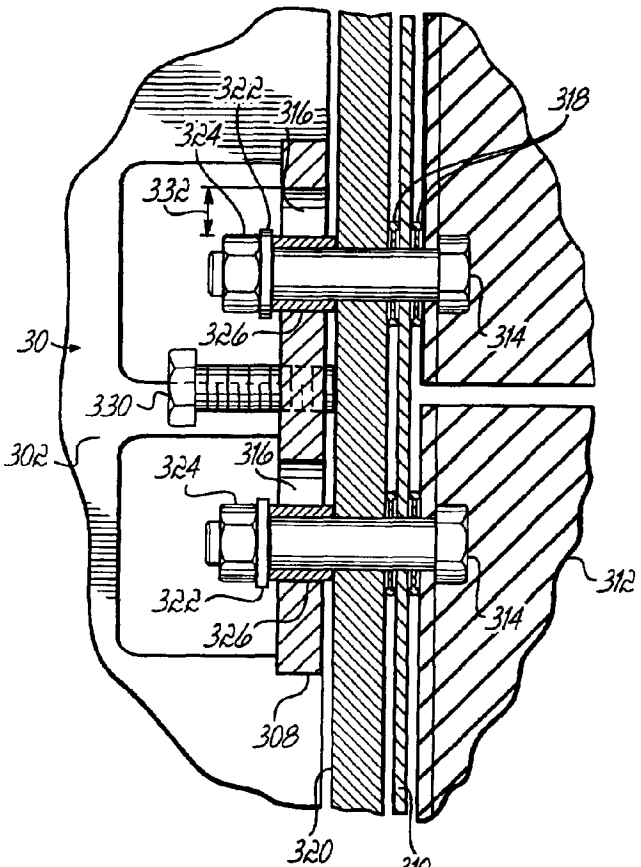

Referring now to FIGS. 5A–5C, and as mentioned above, base plate 308 can include slots 316 therein through which plug bolts 314 pass. Slots 316 permit the diaphragm plate 310 to be movable in a vertical direction parallel to the plane defined by the coke oven door jamb in an amount shown at 332.

Figure 6:
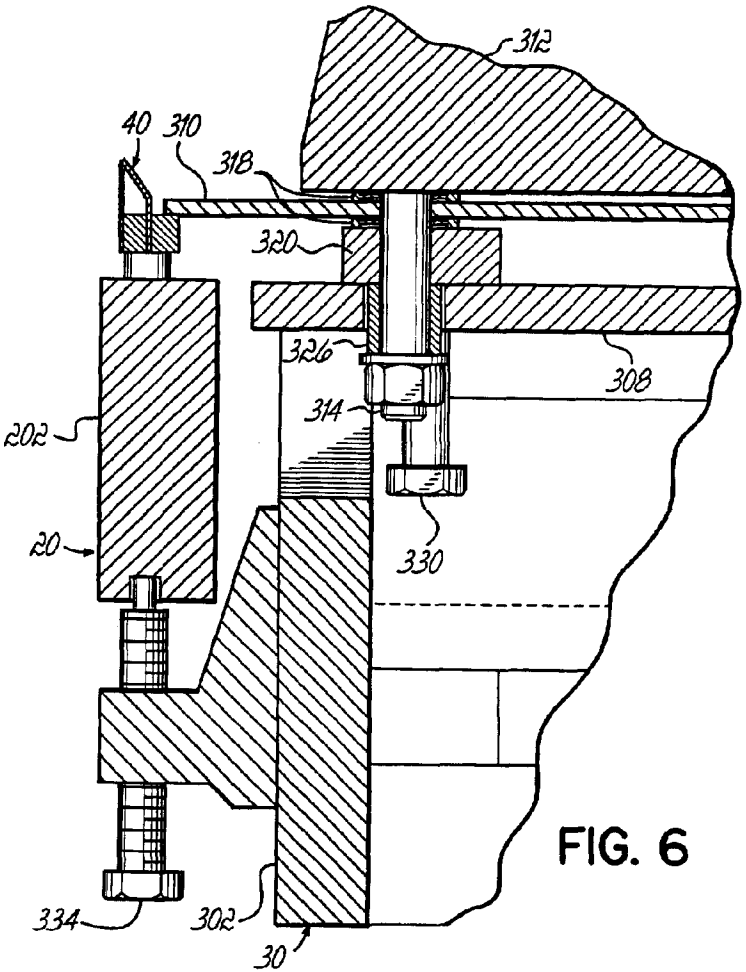
FIG. 6 is a view taken along line 6—6 of FIG. 2.

Referring now to FIG. 6, the inner frame 30 can further include selectably adjustable force applying members 334 operably mounted to the inner frame 30 and adapted for moving the outer frame 20 toward the coke oven door jamb 50.

Referring back to FIGS. 1 and 2, inner frame 30 can include conventional top 336 and bottom 338 door hanger blocks, top 340 and bottom 342 door guides, and top 344 and bottom 346 door locks.

The coke oven door 10 of the present invention allows for the diaphragm plate 310 and seal 40 to float independently of the main door body (inner frame 30). The outer frame 20 and spring plunger assemblies 208 will follow the profile of the seal 40 and maintain uniform pressure on the seal 40. If a jamb 50 survey is available the door 10 can be preset before it is delivered to the battery which will save considerable time during installation of doors 10. The door 10 of the present invention will flex enough to accommodate a top-to-bottom twist of 1.5 to 2 inches and peak-to-valley surface deviation (from flat) in the jamb surface of 0.75 inches for a six meter coke oven door jamb.

Those skilled in the art will readily recognize numerous adaptations and modifications which can be made to the present invention which will result in an improved coke oven door, yet all of which will fall within the spirit and scope of the present invention as defined in the following claims. Accordingly, the invention is to be limited only by the scope of the following claims and their equivalents.

What is claimed is:

1. A coke oven door comprising:

a generally rectangular outer frame;

a generally rectangular inner frame positioned within said outer frame; and a seal operably mounted to said inner frame and adapted for effecting sealing against a jamb of a coke oven;

said outer frame adapted for moving said seal toward the jamb;

said outer and inner frames pivotally connected so as to be able to pivot relative to one another about a longitudinal pivot axis.

2. The coke oven door of claim 1, said inner frame includes a pair of side frame members and a pair of end frame members;

said outer frame includes a pair of side frame members and a pair of end frame members;

said outer frame side frame members are interconnected to said outer frame end frame members via pin connections for relative pivotal movement such that said outer frame side frame members can remain parallel to said inner frame side frame members during pivoting of said outer frame relative to said inner frame about the longitudinal pivot axis.

3. The coke oven door of claim 2 wherein said inner frame includes limit structure to maintain said outer frame side frame members generally parallel with said inner frame side frame members during pivoting of said outer frame relative to said inner frame about the longitudinal pivot axis.

4. The coke oven door of claim 1, said inner frame includes a base plate;

said inner frame includes a diaphragm plate;

said seal operably mounted to said diaphragm plate around a periphery thereof;

said diaphragm plate operably mounted to said base plate.

5. The coke oven door of claim 1, said outer frame including selectably adjustable force applying members operably mounted thereto and adapted for moving said seal toward the jamb.

6. The coke oven door of claim 4 wherein said diaphragm plate is freely movable relative to said base plate within limits.

7. The coke oven door of claim 6 wherein said diaphragm plate is movable in a direction perpendicular to a plane defined by the door jamb.

8. The coke oven door of claim 6 wherein said diaphragm plate is movable in a direction parallel to a plane defined by the door jamb.

9. The coke oven door of claim 6 wherein said diaphragm plate is movable in a direction parallel to a plane defined by the door jamb in a direction perpendicular to the plane defined by the door jamb.

10. The coke oven door of claim 1, said inner frame including selectably adjustable force applying members operably mounted thereto and adapted for moving said outer frame toward the jamb.

11. A coke oven door comprising:

a generally rectangular outer frame;

a generally rectangular inner frame positioned within said outer frame;

a seal operably mounted to said inner frame and adapted for effecting sealing against a jamb of a coke oven;

selectably adjustable force applying members operably mounted to said outer frame and adapted for moving said seal toward the jamb; and selectably adjustable force applying members operably mounted to said inner frame and adapted for moving said outer frame toward the jamb.

12. The coke oven door of claim 11, said inner frame includes a base plate;

said inner frame includes a diaphragm plate;

said seal operably mounted to said diaphragm plate around a periphery thereof;

said diaphragm plate operably mounted to said base plate.

13. The coke oven door of claim 12 wherein said diaphragm plate is freely movable relative to said base plate within limits.

14. The coke oven door of claim 13 wherein said diaphragm plate is movable in a direction perpendicular to a plane defined by the door jamb.

15. The coke oven door of claim 13 wherein said diaphragm plate is movable in a direction parallel to a plane defined by the door jamb.

16. The coke oven door of claim 13 wherein said diaphragm plate is movable in a direction parallel to a plane defined by the door jamb and in a direction perpendicular to the plane defined by the door jamb.

17. A coke oven door comprising:

a generally rectangular frame including a pair of side frame members, a pair of end frame members and a base plate;

a diaphragm plate; and a seal operably mounted to said diaphragm plate around a periphery thereof and adapted for sealing against a jamb of a coke oven;

said diaphragm plate operably mounted to said base plate so as to be freely movable relative thereto within limits in a direction parallel to a plane defined by the door jamb and in a direction perpendicular to the plane defined by the door jamb.

18. The coke oven door of claim 17, said rectangular frame comprising selectably adjustable force applying members operably mounted thereto and adapted for moving said seal toward the jamb.

19. A coke oven door comprising:

a generally rectangular outer frame;

a generally rectangular inner frame including a base plate and positioned within said outer frame;

said outer and inner frames pivotally connected so as to be able to pivot relative to one another about a longitudinal pivot axis;

a diaphragm plate;

a seal operably mounted to said diaphragm plate around a periphery thereof and adapted for sealing against a jamb of a coke oven;

said diaphragm plate operably mounted to said base plate so as to be freely movable relative thereto within limits in a direction parallel to a plane defined by the door jamb and in a direction perpendicular to the plane defined by the door jamb;

selectably adjustable force applying members operably mounted to said outer frame and adapted for moving said seal toward the jamb; and selectably adjustable force applying members operably mounted to said inner frame and adapted for moving said outer frame toward the jamb.

20. The coke oven door of claim 19, said inner frame includes a pair of side frame members and a pair of end frame members;

said outer frame includes a pair of side frame members and a pair of end frame members;

said outer frame side frame members are interconnected to said outer frame end frame members via pin connections for relative pivotal movement such that said outer frame side frame members can remain parallel to said inner frame side frame members during pivoting of said outer frame relative to said inner frame about the longitudinal pivot axis.

21. The coke oven door of claim 20 wherein said inner frame includes limit structure to maintain said outer frame side frame members generally parallel with said inner frame side frame members during pivoting of said outer frame relative to said inner frame about the longitudinal pivot axis.

22. A coke oven door comprising:

a generally rectangular outer frame;

a generally rectangular inner frame positioned within said outer frame; and a seal operably mounted to one of said inner and outer frames and adapted for effecting sealing against a jamb of a coke oven;

said inner and outer frames pivotally connected so as to be able to pivot relative to one another about a longitudinal pivot axis.

23. The coke oven door of claim 22, said other frame adapted for moving said seal toward the jamb.

24. The coke oven door of claim 22, said one frame adapted for moving said other frame toward the jamb.

25. The coke oven door of claim 22, said other frame including selectably adjustable force applying members operably mounted thereto and adapted for moving said seal toward the jamb.

26. The coke oven door of claim 22, said one frame including selectably adjustable force applying members operably mounted, thereto and adapted for moving said other frame toward the jamb.

27. The coke oven door of claim 22, said seal operably mounted to said inner frame.

* * * * *

UNITED STATES PATENT AND TRADEMARK OFFICE

CERTIFICATE OF CORRECTION

PATENT NO. : 6,916,406 B2
APPLICATION NO. : 10/375601
DATED : July 12, 2005
INVENTOR(S) : Billy Carr Baird It is certified that error appears in the above-identified patent and that said Letters Patent is hereby corrected as shown below:

Column 2, line 9 should read: -- positioned within the outer frame, a seal operably mounted --, not "positioned within the outer frame, a seat operably mounted".

Column 7, Line 3, Claim 26, should read: -- applying members operably mounted thereto and --, not "applying members operably mounted, thereto and".

Signed and Sealed this

Twenty-fifth Day of December, 2007

JON W. DUDAS
*Director of the United States Patent and Trademark Office*